US005546109A

United States Patent [19]

Nakano

[11] Patent Number: 5,546,109

[45] Date of Patent: Aug. 13, 1996

[54] FILTER DEVICE FOR INK JET PRINTER

[75] Inventor: Hiroshi Nakano, Nagoya, Japan

[73] Assignee: Brother Kogyo Kabushiki Kaisha, Nagoya, Japan

[21] Appl. No.: 264,995

[22] Filed: Jun. 24, 1994

[30] Foreign Application Priority Data

Jul. 2, 1993 [JP] Japan ..... 5-164786

[51] Int. Cl.[6] ..... B41J 2/175; B41J 2/19

[52] U.S. Cl. ..... 347/93; 347/92

[58] Field of Search ..... 347/92, 93

[56] References Cited

FOREIGN PATENT DOCUMENTS 60-19825 5/1985 Japan ..... 347/93

*Primary Examiner*—Valerie A. Lund
*Attorney, Agent, or Firm*—Oliff & Berridge

[57] ABSTRACT

A filter device that is usable for a print head in an ink jet printer. The filter device is interposed between an ink reservoir and the ink ejecting nozzles. Two flat, permeable thin films are juxtaposed with an adequate clearance from the inlet of a filter chamber toward the outlet thereof to define negative pressure chambers. A flat filter member is interposed in parallel with an adequate clearance H between the two permeable thin films. Dust contained in ink is caught by the filter member. A negative pressure generator is used to decrease the pressure inside the negative pressure chamber to less than that of atmospheric pressure so as to remove bubbles contained in the ink in the filter chamber. Consequently, it is possible to prevent dust and bubbles from intruding into the ink ejecting nozzles in the ink jet printer to ensure there is no interruption of the ejection of the ink.

18 Claims, 3 Drawing Sheets

FILTER DEVICE FOR INK JET PRINTER

BACKGROUND OF THE INVENTION

1. Field of the Invention

The invention relates to a filter device for a print head in an ink jet printer and, more particularly, to a filter device disposed on the way of an ink supply passage, for removing foreign materials and bubbles contained in ink.

2. Description of the Related Art

Heretofore, there have been devised print heads in an ink jet printer that are provided with a filter device for removing foreign materials and bubbles contained in ink. First, the schematic arrangement of such a conventional print head 100 will be explained below referring to FIG. 4, which is a longitudinal sectional view of a print head with a conventional filter device mounted thereon.

The print head 100 is formed mainly of a frame 101 made of magnesium alloy, which is light in weight and excellent in thermal conductivity, and is principally composed of an ink ejection unit 102, an ink reservoir 107, and an ink passage unit 114 interposed between the former two. The ink passage unit 114 and the ink reservoir 107 are separated from each other via a partition wall 101A extending downward in substantially the center of the frame 101, while they are communicated at the respective lower portions thereof with each other via a lower port 107A.

The ink reservoir 107 is provided with an air vent 109 opened to the atmosphere at the upper portion thereof, and an ink supply port 108 opening to the side at the upper portion thereof. A filter device 121 is incorporated inside the ink reservoir 107 in such a manner as to divide it into two parts. The volume of the ink reservoir 107 is about 2 $cm^3$ As described above, the ink passage unit 114 and the ink reservoir 107 communicate at their respective lower portions with each other via the lower port 107A.

The ink passage unit 114 is constituted of an ink passage 112, a pair of negative pressure chambers 116A and 116B, and a couple of permeable thin films 120A and 120B.

The ink passage 112 is defined by the pair of permeable thin films 120A and 120B and the side wall of the frame 101. The ink passage 112 communicates at its lower portion with the ink reservoir 107 via the lower port 107A. The negative pressure chamber 116A is made up of one permeable thin film 120A, the partition wall 101A, and the side wall of the frame 101; and the negative pressure chamber 116B, of the other permeable thin film 120B and the outer wall 101B of the frame 101. The negative pressure chambers 116A and 116B are connected to a negative pressure generator, not shown, via a tube, not illustrated. The negative pressure generator is capable of keeping a predetermined negative pressure inside the negative pressure chambers 116A and 116B. The ink passage 112 communicates at its upper portion with an ink ejecting nozzle 106 of the ink ejection unit 102 through an ink inlet 102A.

The plurality of ink ejection units 102 are disposed according to the resolution of the ink jet printer. Each ink ejection unit 102 is composed of a piezoelectric vibrating element 103, an ink ejecting chamber 104, and the ink ejecting nozzle 106. The ink ejecting nozzle 106, which is made of 42-alloy (an alloy of iron mixed with 42% of nickel), is fixed to the frame 101. The piezoelectric vibrating element 103 and the ink ejecting chamber 104 are provided sideways in the ink ejecting nozzle 106 in one-to-one correspondence to the ink ejection unit 102. To the tip of the ink ejecting nozzle 106 is secured an orifice plate 110 made of nickel with orifices (ejecting ports) 110A each having a diameter of 50 μm formed at predetermined intervals (i.e., at the same intervals as those of the ink ejecting nozzles 106).

In the print head 100 structured as above, the numerous piezoelectric vibrating elements 103 are selectively vibrated on the basis of an image signal. Then, ink 105 supplied to the ink ejecting chamber 104 is selectively ejected in drops toward a recording paper, not shown, through the orifices 110A formed at the tip of the ink ejecting nozzle 106. Accordingly, an image can be recorded on the recording paper with the ink 105. Foreign materials, such as dust, which is contained in the ink 105 supplied from the ink supply port 108, can be caught and removed when the ink 105 passes through the filter device 121A from left to right as viewed in FIG. 4. The clean ink 105 without any foreign material is further supplied from the right chamber in the ink reservoir 107 to the ink ejection unit 102 through the lower port 107A and the ink passage 112. On the way, air (fine bubbles) contained in the ink 105 is sucked toward the pair of permeable thin films 120A and 120B by a negative pressure is the negative pressure chambers 116A and 116B, and further, is discharged to the negative pressure chambers 116A and 116B through the pair of permeable thin films 120A and 120B.

However, since the fine filter device 121 for catching and removing the dust contained in the ink is disposed inside the ink reservoir 107 in the above described print head 100, the following problems have arisen depending on the positioning of the filter device 121.

Three possible placements of the filter device 121 are discussed below:

(1) In the case where a filter device 121A is disposed near the ink supply port 108 and inside the ink reservoir 107 as shown by the solid line in FIG. 4, as a matter of course, a volume of the ink reservoir 107 on the left side of the filter device 121A becomes smaller. As a result, although an ink supply amount to the ink reservoir 107 is 1–2 $cm^3$ at a time, there may occur a possibility that the ink supply amount supplied cannot keep up with the rate of ink consumption in the ink ejection unit 102 since the volume of the ink reservoir 107 on the left side of the filter device 121A is small and a speed of the ink 105 passing through the filter device 121A is low. In the case where an ink amount supplied is smaller than the ink consumption, the ink amount contained inside the ink reservoir 107 on the left side of the filter device 121A becomes small so that bubbles are likely to be contained in the ink 105 in the ink reservoir 107 on the right side. Consequently, the ink 105 cannot be ejected in the ink ejection unit 102. Moreover, if the ink 105 is supplied to the ink reservoir 107 through the ink supply port 108 under large pressure in order to increase the speed of the ink 105 passing through the filter device 121A, a device for applying the pressure to the ink 105 must be provided with the disadvantages of a high production cost and a large size.

(2) In the case where a filter device 121B is disposed on the right side inside the ink reservoir 107, as shown by the chain line in FIG. 4, as the volume of the ink reservoir 107 on the left side of the filter device 121B becomes larger, newly supplied ink 105 can be easily stored in the ink reservoir 107 on the left side, thus dispensing with pressure needed for supplying the ink 105, which is necessary in the above case (1). However, in the case where the ink consumption in the ink ejection unit 102 is large, the amount of the ink passing through the filter device 121B is insufficient so that the ink amount (after filtration) stored in the ink reservoir 107 on the right side of the filter device 121B is decreased rapidly. Then, air (bubbles) is sucked into the ink passage 112 through the lower port 107A of the ink reservoir 107, with insufficient suction of the air (removal of bubbles) into the negative pressure chambers 116A and 116B through the permeable thin films 120A and 120B. As a result, the bubbles remain inside the ink ejection unit 102, hence producing a result that the ink cannot be ejected.

(3) In the case where a filter device 121C is disposed so as to vertically divide the ink reservoir 107, as shown by the two-dot chain line in FIG. 4, as the filter device 121C is fine as described previously, air contained in the ink 105 stays in a form of large bubbles under the filter device 121C. Consequently, the ink passing area of the filter device 121C becomes smaller, whereby the ink supply function is deteriorated. In the worst case, the whole lower surface of the filter device 121C is covered with the bubbles so that the ink cannot be passed through and subsequently be ejected.

SUMMARY OF THE INVENTION

The invention has been accomplished in an attempt to solve the above problems observed in the prior art. The object of this invention is to provide a filter device in an ink jet printer for preventing such a phenomenon that ink cannot be ejected while securing a function of removing dust contained in the ink.

In order to achieve the above-stated object, the filter device according to the invention is disposed on the way of an ink supply passage to an ink ejecting nozzle. The filter device is provided with a filter member disposed substantially along an ink passing direction between the inlet and outlet of a filter chamber, permeable members arranged in parallel at suitable intervals apart from the wide surface of the filter member and negative pressure chambers for applying negative pressure are formed on the sides of the permeable members opposite to the filter member.

Thus, the filter member is disposed substantially along the ink passing direction between the inlet and outlet of the filter chamber, the permeable members are arranged in parallel at suitable intervals apart from the wide surface of the filter member, and the negative pressure chambers for applying negative pressure are formed on sides of the permeable members opposite to the filter member. Accordingly, it is possible to prevent such a phenomenon that the ink cannot be ejected while securing a function of removing dust contained in the ink.

As is apparent from the above description, the permeable members are adapted to partition the filter chamber and the negative pressure chambers and, further, the filter member and the permeable members are juxtaposed in confrontation with each other over a large area. Consequently, bubbles generated in the filter chamber can be securely removed by the permeable members at high efficiency, with an improvement in dust removing efficiency of the filter member.

BRIEF DESCRIPTION OF THE DRAWINGS

Preferred embodiments of the invention will be described in detail with reference to the following figures, wherein.

DESCRIPTION OF THE PREFERRED EMBODIMENTS

A filter device embodying the invention will be described hereinafter with reference to the accompanying drawings.

Figure 1:
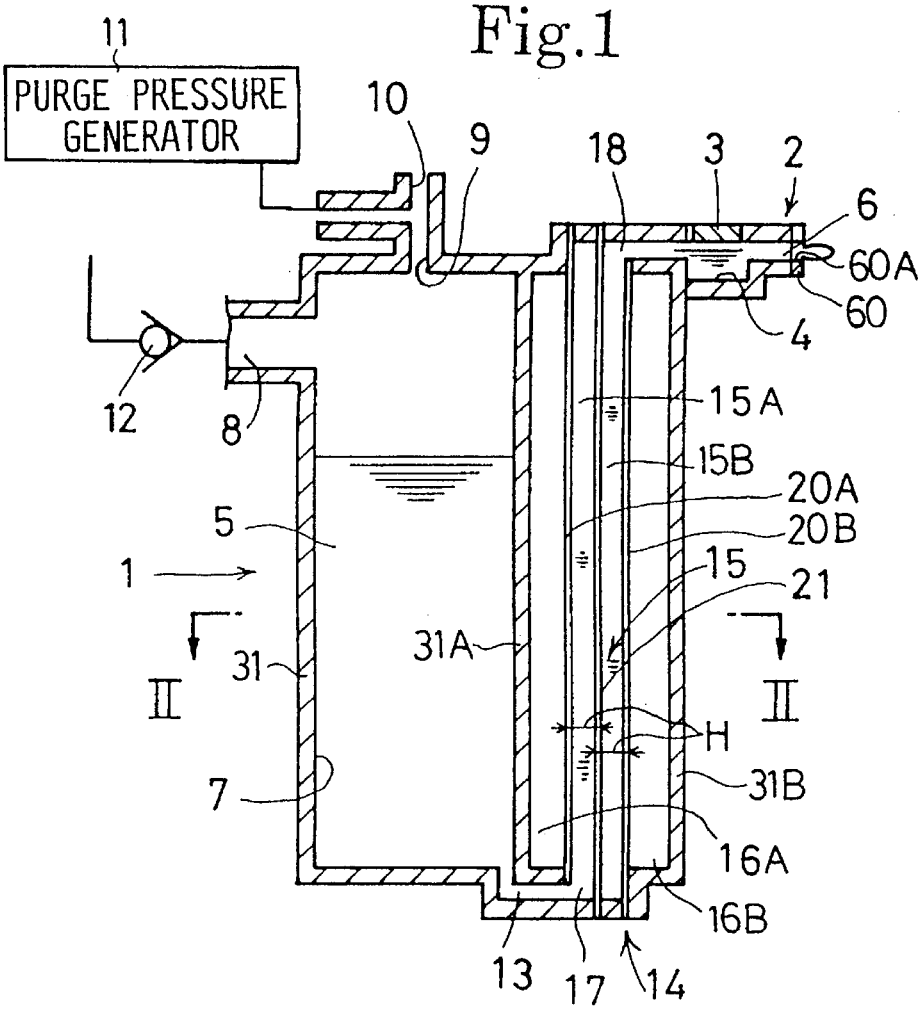
FIG. 1 is a longitudinal sectional view showing a print head with a filter device mounted thereon in a first embodiment according to the invention.
Figure 2:
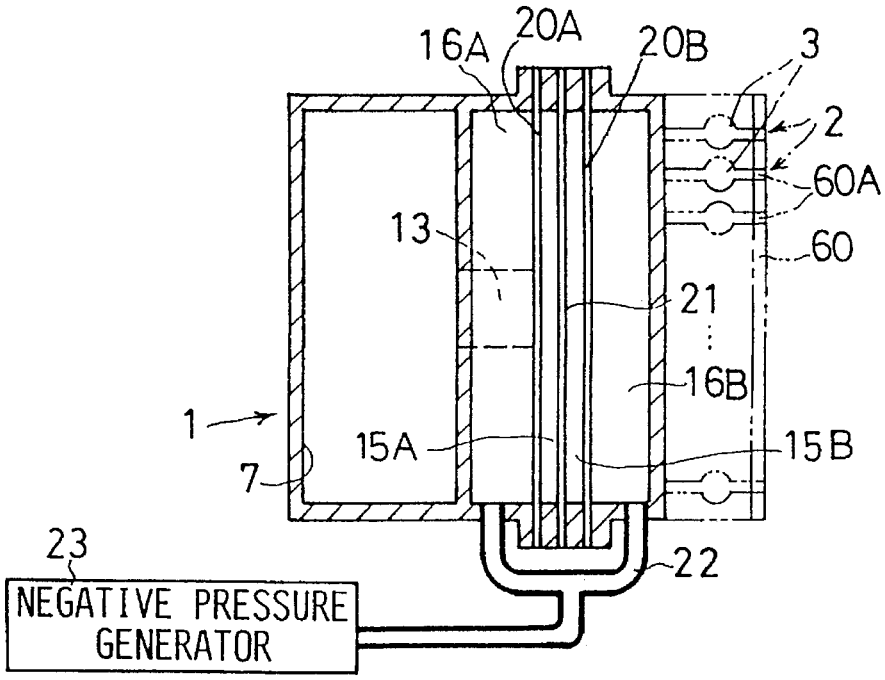
FIG. 2 is a transverse sectional view showing the print head, taken along the line II—II of FIG. 1.

Referring to FIGS. 1 and 2, a print head 1 for use in an ink jet printer and with a filter device 14 mounted thereon will be explained in detail in a first embodiment.

The print head 1 is structured to be moved in the lateral direction while confronting an obverse side of a recording paper by a moving means, not shown, in the conventional printer.

The print head 1 is formed mainly of a frame 31 made of magnesium alloy, which is light in weight and excellent in thermal conductivity, and is principally composed of an ink ejection unit 2, the filter device 14, and an ink reservoir 7. The ink ejection unit 2 and the filter device 14 are separated from the ink reservoir 7 by a partition wall 31A extending downward in substantially the center of the frame 31. The filter device 14 communicates at its lower portion with the ink reservoir 7 via a communicating path 13.

On the upper portion of the ink reservoir 7, capable of storing ink 5, is a hole 9 open to the atmosphere. An air vent 10 communicating with the atmosphere is formed on one of the tubes that fork from the hole 9 in such a manner as to be freely opened or closed by a device, not illustrated. A purge pressure generator 11 is connected to the other tube, wherein a purge pressure connotes a pressure to be supplied to the ink reservoir 7 in order to exhaust all of the stale ink 5 remaining inside the print head 1 through an ink ejecting nozzle 6.

On the side of the upper portion of the ink reservoir 7 is formed an ink supply port 8 capable of supplying the ink 5. The ink supply port 8 is provided with a check valve 12 for preventing the ink 5 from reversely flowing outward of the print head 1 from the ink reservoir 7 through the ink supply port 8. The check valve 12 permits ink to be supplied through ink supply port 8 to print head 1 at predetermined timings. A volume of the ink reservoir 7 is set to approximately 2 $cm^3$ The ink reservoir 7 communicates at its lower portion with the filter device 14 via the communicating path 13. Accordingly, the ink 5 stored in the ink reservoir 7 is supplied to the filter device 14.

The filter device 14 comprises a filter chamber 15 and a pair of negative pressure chambers 16A and 16B. Furthermore, the filter chamber 15 consists of a couple of permeable thin films 20A,20B, a filter member 21, and the outer wall 31B of the frame 31.

The permeable thin films 20A,20B are not permeable to the ink 5 but are to air (bubbles) contained in the ink 5. They are made of fabric woven of synthetic resin fiber such as nylon resin fiber or silicone resin fiber having a very fine mesh that passes air but prevents passage of the ink.

The filter member 21 is made of a stainless wire having a diameter of 50 μm in a so-called "Twill Dutch Weave," or fabric woven of nylon resin fiber or silicone resin fiber woven into a mesh having a diameter of the openings of approximately 10 μm. Consequently, dust likely to clog the ink ejecting nozzle 6 of 50 μm in diameter can be removed by the filter member 21. There is an alternative to use a filter made of thin metal plate bored by an electron beam or a laser beam, or a filter formed into the desired mesh by pattern etching.

The filter chamber 15 which constitutes an ink supply passage between the reservoir 7 and the ink ejection unit 2, is divided into an upstream filter chamber 15A and a downstream filter chamber 15B by the filter member 21. The upstream filter chamber 15A is communicated at the lower end thereof (i.e., at an inlet 17 of the ink 5) with the ink reservoir 7 via the communicating path 13. The negative pressure chamber 16A is defined by the permeable thin film 20A constituting a part of the upstream filter chamber 15A, the partition wall 31A, and the outer wall 31B of the frame 31.

Meanwhile, the downstream filter chamber 15B is communicated at the upper end thereof (i.e., at an outlet 18 of the ink 5 toward the ink ejecting nozzle 6) with the ink ejecting nozzle 6. The other negative pressure chamber 16B is defined by the permeable thin film 20B, constituting a part of the downstream filter chamber 15B, and the outer wall 31B of the frame 31. Both of the negative pressure chambers 16A,16B are connected to a negative pressure generator 23 via a tube 22, as shown in FIG. 2.

The negative pressure generator 23 comprises a piston, a cylinder, a check valve and a driving means, and is capable of generating a negative pressure of −60 cmHg to −70 cmHg inside the negative pressure chambers 16A,16B.

Since the pair of flat permeable thin films 20A,20B are arranged substantially in parallel at a narrow clearance H (about 0.5 mm to 1.5 mm, although the clearance is dependent on the air permeability of the permeable thin film), the filter device 14 is divided into the filter chamber 15 and the negative pressure chambers 16A,16B. Moreover, the single, flat filter member 21 is positioned between the permeable thin films 20A,20B so that the filter chamber 15 is divided into the upstream filter chamber 15A and the downstream filter chamber 15B. Consequently, the ink 5 from the ink reservoir 7 is supplied to the downstream filter chamber 15B from the upstream filter chamber 15A through the filter member 21 and then to ink ejection unit 2.

In the case where the end of the flat permeable thin films 20A,20B or the end of the filter member 21 is exposed to the exterior (i.e., to the atmosphere) in the print head 1, such a possibility may occur that air intrudes or the ink leaks from the exposed portion. Therefore, the ends may be preferably sealed by a nonpermeable adhesive.

A plurality of ink ejection units 2 are disposed according to the resolution of the ink jet printer. The ink ejection unit 2 comprises a piezoelectric vibrating element 3, an ink ejecting chamber 4, and the ink ejecting nozzle 6.

The ink ejecting nozzle 6 is made of a 42-alloy containing 42% of nickel mixed in iron. The piezoelectric vibrating element 3 and the ink ejecting chamber 4 are disposed sideways in the ink ejecting nozzle 6 in one-to-one correspondence to the ink ejection unit 2. The ink ejecting nozzle 6 is fixed to the frame 31. At the tip of each ink ejecting nozzle 6 is a nickel orifice plate 60 provided with orifices 60A (ejecting ports), of 50 μm diameter, arranged at predetermined intervals (at the same intervals as those of the ink ejecting nozzles 6).

Next, operation of the print head 1 with the filter device 14 in the first embodiment mounted thereon will be described with reference to FIGS. 1 and 2.

When a power source, not shown, is turned on by a user, the purge pressure generator 11 is operated at the initial stage to apply pressure to the inside of the ink reservoir 7. The stale ink 5 remaining in the print head 1 is discharged from the ink ejecting nozzles 6 through the orifices 60A. Fresh ink 5 is then introduced to fill the ink reservoir 7 via the ink supply port 8. The air vent 10 is closed by means of a device, not depicted. The purge pressure generator 11 is operated again to apply pressure to the inside of the ink reservoir 7. The negative pressure generator 23 also is operated and, then, a predetermined negative pressure is created and maintained inside the negative pressure chambers 16A,16B.

The ink 5 stored in the ink reservoir 7 is supplied under pressure to the upstream filter chamber 15A through the communicating path 13, to be filled therein while wetting the inner surfaces of the filter member 21 and permeable thin film 20A. When the ink 5 passes through the filter member 21, dust contained in the ink 5 is caught on the upstream side of the filter member 21. Accordingly, only the cleaned ink 5 enters the downstream filter chamber 15B. Bubbles, which are contained in the ink 5 and stay near the upstream filter chamber 15A, are drawn through the permeable thin film 20A to be discharged to the negative pressure chamber 16A. Moreover, even if air is contained in the ink 5 after passing through the filter member 21 so as to be turned into bubbles inside the downstream filter chamber 15B, the bubbles (air) are drawn through the other permeable thin film 20B to be discharged to the negative pressure chamber 16B. As a result, no bubbles are contained in the ink 5 flowing in the ink ejection unit 2 from the downstream filter chamber 15B through the outlet 18.

Incidentally, if the purge pressure generator 11 abruptly applies a very high pressure, such as, two atmospheres or more, when fresh ink 5 is supplied from the ink supply port 8, a large amount of bubbles may be produced in the ink 5 in passing through the filter member 21. The ink 5 may be supplied into the ink ejection unit 2 before all of the bubbles are discharged to the negative pressure chambers 16A,16B through the permeable thin films 20A,20B. That is, the ink 5 containing the bubbles is supplied to the ink ejection unit 2, resulting in the condition that the ink cannot be ejected as previously discussed. Consequently, it is preferable that fresh ink 5 be supplied from the ink supply port 8 under a purge pressure only slightly higher than an atmospheric pressure (e.g., about 1 cmHg higher than atmosphere) for a time as long as one minute.

During print operation, the print head 1 is mounted on a carriage, not shown, for free movement in the lateral direction. The ink 5 waves inside the ink reservoir 7 to thus contain the bubbles. However, in the filter device 14 according to the invention, the long ink supply passage is formed from the inlet 17 of the filter chamber 15 toward the outlet 18 thereof. The permeable thin films 20A,20B and the filter member 21 are arranged substantially in parallel along the ink supply passage within the narrow clearance H in mutual confrontation over a large area. As a result, it is possible to enhance the efficiency of dust filtration and catching by the filter member 21 and, further, to improve the efficiency of removal of the bubbles contained in the ink 5. Since the filter member 21 is interposed substantially in parallel and between the two permeable thin films 20A,20B for defining the filter chamber 15 and the negative pressure chambers 16A,16B, the bubbles found in the filter chamber 15 can be securely removed. Consequently, an ink nonpermeable portion is unlikely to be generated due to adhesion of the bubbles to the surfaces of the filter member 21 despite long-term use. Therefore, ink ejection in the ink ejection unit 2 can be stabilized for a long period.

The ink 5 staying in the ink ejecting chamber 4 is ejected in drops through the orifices 60A formed on the orifice plate 60 disposed at the tip of the ink ejecting nozzles 6 toward a recording paper, not illustrated, with application of selective vibration by the known piezoelectric vibrating elements 3.

Figure 3:
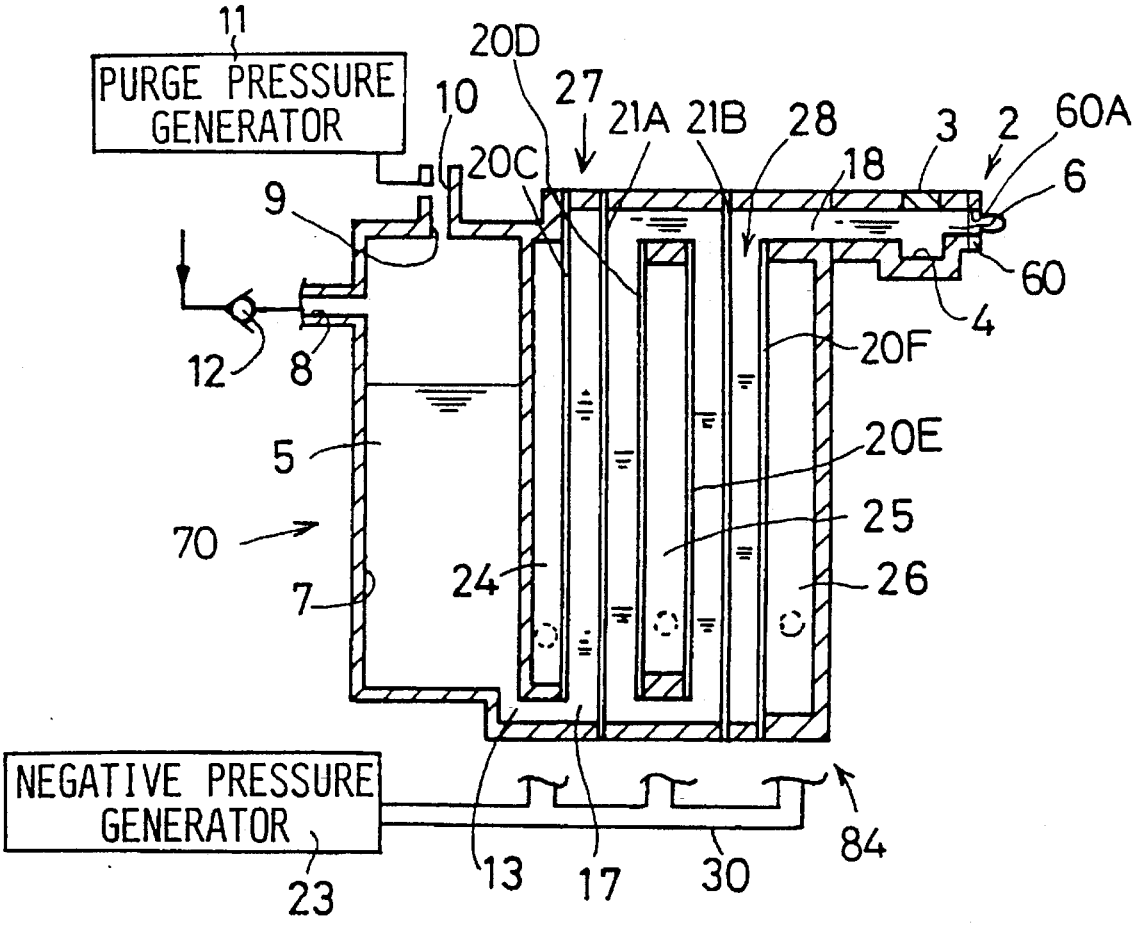
FIG. 3 is a longitudinal sectional view showing a print head with a filter device mounted thereon in a second embodiment according to the invention.
Figure 4:
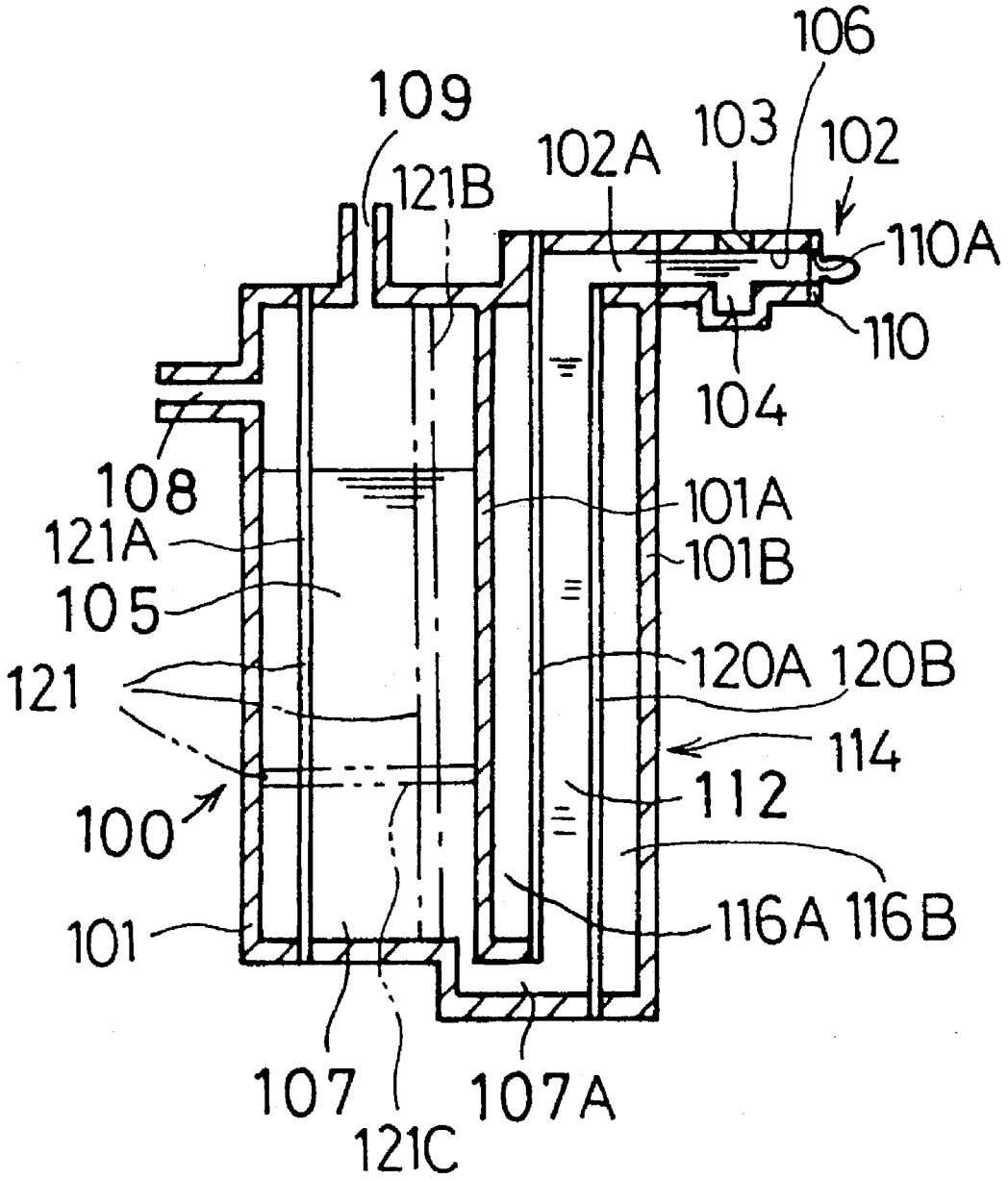
Fig.4 RELATED ART
FIG. 4 is a longitudinal sectional view showing a print head with a conventional filter device mounted thereon.

Next, a print head 70 with a filter device 84 in a second embodiment mounted thereon will be described hereunder referring to FIG. 3. Parts like or corresponding to those of the print head 1 with the filter device 14 in the first embodiment mounted thereon are denoted by the same reference numerals, and the description thereof will be omitted.

In the filter device 84 in the second embodiment, four flat, permeable thin films 20C,20D,20E,20F are arranged in parallel so as to define three negative pressure chambers 24,25,26, among which are formed a first and a second filter chamber 27 and 28. In the first filter chamber 27, a filter member 21A is interposed substantially in parallel between the permeable thin films 20C,20D; and in the second filter chamber 28, another filter member 21B is disposed substantially in parallel between the permeable thin films 20E,20F. Each of the two filter members 21A,21B is formed of a mesh having the same fineness. The three negative pressure chambers 24,25,26 are connected to a negative pressure generator 23 via a tube 30.

In the print head 70 with the filter device 84 in the second embodiment mounted thereon, dust can be filtrated by means of the filter members 21A,21B at two stages, the three negative pressure chambers 24,25,26 are defined, and ink 5 can be brought into contact with the four permeable thin films 20C,20D,20E,20F. Eventually, filtrating performance and bubble removing efficiency can be improved over that of the print head 1 having the filter device of the first embodiment mounted thereon.

It is to be understood that the invention is not restricted to the particular embodiments given above, and various modifications and alterations can be added thereto without departing from the scope of the invention.

Although the filter device is incorporated inside the print head in the first and second embodiments, the print head may be composed of only the ink ejection unit independent of the filter device and the ink reservoir.

Additionally, although the two filter members 21A,21B are formed of meshes having the same fineness in the filter device 84 of the second embodiment, the upstream filter member 21A may be formed more roughly than the downstream filter member 21B. In this case, slightly larger dust and fine dust can be caught by the upstream filter member 21A and the downstream filter member 21B in a partly charged manner, respectively, whereby such an effect is attainable that the lifetime of the filter members 21A,21B can be prolonged.

What is claimed is:

1. A filter device disposed on the way of an ink supply passage toward ink ejecting nozzles in an ink jet printer, comprising:

a filter member disposed substantially along an ink flowing direction from an inlet of a filter chamber toward an outlet thereof;

permeable members substantially juxtaposed and spaced from a wide surface of said filter member; and a first negative pressure chamber disposed on an upstream side and a second negative pressure chamber on a downstream side, with respect to the ink flowing direction, of said filter member, said first and second negative pressure chambers separated from the ink supply passage by the permeable members and applying negative pressure to the ink supply passage.

2. A filter device for removing foreign materials, such as dust contained in ink, comprising:

an ink supply passage for supplying the ink;

a filter member disposed substantially in parallel with said ink supply passage, for dividing said ink supply passage into a first filter chamber and a second filter chamber;

negative pressure chambers disposed along said ink supply passage adjacent to at least one of said two filter chambers; and permeable members permeable only to air, wherein said permeable members are interposed between said filter chamber and said negative pressure chambers.

3. The filter device according to claim 2, wherein said permeable members comprise two permeable members and a distance from each permeable member to said filter member is substantially equal.

4. The filter device according to claim 2, wherein a distance from said permeable members to said filter member is in a range of 0.5–1.5 mm.

5. The filter device according to claim 2, wherein said first filter chamber has almost an identical volume as said second filter chamber.

6. The filter device according to claim 2, wherein said permeable members and said filter member are substantially parallel to each other and have approximately an equal surface area.

7. The filter device according to claim 2, wherein said ink supply passage is provided for each said filter member and where a plurality of filter members are used, each said filter member divides said ink supply passage into said two filter chambers.

8. The filter device according to claim 7, wherein a fineness of mesh of each of said plurality of filter members are equal.

9. The filter device according to claim 7, wherein a mesh of said filter member disposed downstream is finer than that of said filter member disposed upstream when said plurality of filter members are provided.

10. A print head for use in an ink jet printer, comprising:

an ink reservoir for supplying and storing ink;

an ink ejection unit for ejecting the ink;

an ink supply passage for supplying the ink from said ink reservoir to said ink ejection unit;

a filter member disposed substantially in parallel with said ink supply passage, for dividing said ink supply passage into a first filter chamber and a second filter chamber;

negative pressure chambers disposed along said ink supply passage adjacent to at least one of said two filter chambers; and permeable members permeable to only air, wherein said permeable members are interposed between said filter chambers and said negative pressure chambers.

11. The print head according to claim 10, wherein a plurality of filter members are used, each said filter member divides said ink supply passage so as to have a filter chamber on each side of each filter member.

12. The print head according to claim 11, wherein a fineness of a mesh of each of said plurality of filter members are equal.

13. The print head according to claim 11, wherein a mesh of said filter member disposed downstream in the ink supply passage is finer than that of said filter member disposed upstream when said plurality of filter members are provided.

14. The print head according to claim 11, wherein there are two permeable members and a distance from each permeable member to said filter member is equal.

15. The print head according to claim 11, wherein a distance from said permeable member to said filter member is in the range of 0.5–1.5 mm.

16. The print head according to claim 10, wherein said first filter chamber has almost an identical volume as said second filter chamber.

17. The print head according to claim 10, wherein said permeable members and said filter member are substantially parallel to each other and have approximately an equal surface area.

18. The print head according to claim 10, wherein said ink ejection unit is formed separate from said ink reservoir and said ink supply passage.

* * * * *